US006776127B2

(12) United States Patent
Osman

(10) Patent No.: US 6,776,127 B2
(45) Date of Patent: Aug. 17, 2004

(54) INTERBORE COOLING SYSTEM

(75) Inventor: Azmi B. Osman, Johor (MY)

(73) Assignee: Petroliam Nasional Berhad, Kuala Lumpur (MY)

( * ) Notice: Subject to any disclaimer, the term of this patent is extended or adjusted under 35 U.S.C. 154(b) by 0 days.

(21) Appl. No.: 10/029,214

(22) Filed: Dec. 20, 2001

(65) Prior Publication Data

US 2002/0100435 A1 Aug. 1, 2002

(30) Foreign Application Priority Data

Dec. 21, 2000 (MY) ..... PI 2000 6079

(51) Int. Cl.[7] ..... F02F 1/10
(52) U.S. Cl. ..... 123/41.72
(58) Field of Search ..... 123/41.72, 41.74, 123/41.79

(56) References Cited

U.S. PATENT DOCUMENTS 3,942,487 A * 3/1976 Zink ..... 123/41.79
4,850,312 A 7/1989 Schwab ..... 123/41.74
5,474,040 A * 12/1995 Murakami et al. ..... 123/195 R
6,205,959 B1 * 3/2001 Smetan et al. ..... 123/41.74

FOREIGN PATENT DOCUMENTS

| | | |
|---|---|---|
| AU | 001 034 U1 | 11/1995 |
| DE | 41 17 112 C1 | 6/1992 |
| EP | 0 223 158 A1 | 5/1987 |
| EP | 0 277 446 A1 | 8/1988 |
| EP | 0628716 | 12/1994 |
| JP | 59043918 | 3/1984 |
| JP | 61112768 | 5/1986 |
| JP | 05141307 | 6/1993 |
| JP | 07119541 | 5/1995 |
| JP | 10-339207 | 12/1998 |
| JP | 2001107801 | 4/2001 |

* cited by examiner

*Primary Examiner*—Tony M. Argenbright
*Assistant Examiner*—Katrina B. Harris
(74) *Attorney, Agent, or Firm*—Dickinson Wright PLLC

(57) ABSTRACT

A cooling system for cooling an interbore bridge of a cylinder block of a water cooled engine, the interbore bridge having a top surface and a central region of minimum width; the cylinder block having a water jacket; the cooling system including at lest one water passage extending from the top of the interbore bridge adjacent the central region to the water jacket. A method of forming the cooling system, and a cylinder block so formed, are also disclosed.

30 Claims, 1 Drawing Sheet

INTERBORE COOLING SYSTEM

CROSS-REFERENCE TO RELATED APPLICATION

This application is based upon and claims priority to Malaysian Patent Application No. PI 2000 6079, filed Dec. 21, 2000, which application is hereby expressly incorporated by reference.

FIELD OF THE INVENTION

This invention relates to improvements in cooling systems of a water-cooled engine and preferably, though not exclusively, to a cooling system to cool the upper regions of an interbore bridge of such an engine.

BACKGROUND OF THE INVENTION

The narrow structure between two cylinders of a cylinder block is known as the interbore bridge. It has a high thermal concentration. This region has high surface to volume ratio, and easily be overheated if exposed to high heat sources. Heat sources can come from combustion within the cylinders, and also from the friction between the piston assembly and cylinder wall.

Problems are likely to occur once the surface temperature of the cylinder wall at the interbore bridge reaches 180°. At that temperature lubrication oil, especially mineral oil, will experience performance deterioration. Deterioration in the lubrication oil may cause friction between the piston and the cylinder wall to increase significantly. This will cause other problems such as, for example, piston scuffing, and excessive wear of the cylinder wall and piston rings.

Cylinder blocks made of aluminum will have additional problems once the temperature exceeds 220° C. At that temperature and above, the aluminum weakens. Excessive bore distortion due to a thermally weakened structure, and thermal expansion, can be problematic to overall engine functionality. High thermal loading can also cause the structure to lose its original properties once the metal temperature is back to normal.

In order to overcome interbore overheating, many types of interbore cooling systems have been proposed including:

1) a full saw cut in the top surface;
2) double saw cuts in the top surface, one on each side of the water passage;
3) crossed-drilled passages from the top surface of stepped bore diameter extending from each end of the interbore bridge;
4) cast water passages; and
5) a water passage created by using a glass core.

Each system has its own advantages and disadvantages. There are many parameters to consider before choosing any particular design, and one particular design may work on one specific application, and not necessarily on others.

It is now a common practice that the one engine block can be used for many different applications. For some applications, the block is used for mass production engines of relatively low performance as well as limited production engines of high performance.

Generally, both maintain the maximum commonality of engine parts. The only parts that are completely different from one to another may be intake and exhaust systems, and camshafts.

To ensure the same cylinder block can be used for high and low performance engines with minor modification, a cylinder block with cylinder liners is one possible option. However, a high performance engine requires an interbore cooling system to cool the interbore bridge. On the other hand, a lower power output engine may not require interbore cooling.

One must therefore consider several options for interbore cooling. Cast water passages and cross-drilled passages are often rejected as, for example, an 8 mm interbore bridge has the liner-aluminum-liner arrangement of 2-4-2 mm. The thickness of the metal between the two liners is not enough to have a cast water passage, and insufficient for cross-drilled passages to pass through.

Interbore cooling options like a full saw cut, double saw cuts, and glass core are, however, available. A full saw cut is widely used for cylinder blocks with liners. The machining process is quite simple, except that the casting process must be accurate or 100% ultrasound is required in order to avoid improper load or damage to the saw during machining. Another problem with a full saw cut is sealing as it requires expensive gaskets. Leaking can also occur because the opening at the top deck requires proper sealing. Moreover, the opening weakens the interbore bridge and bore distortion is likely to occur during engine running due to thermal and mechanical loading.

With double saw cuts, both sides of the interbore bridge are saw cut in order to bring water flow closer to the hottest spot at the center of the interbore bridge. The cylinder head is also machined in order to link the water flow from the saw cuts at the cylinder block. This design requires long machining times, especially with the cylinder head.

The option of using a glass core has been proposed as it can create a water passage between the cylinder liners. The process is not yet in production. The process is also expensive, and must be strictly controlled. The glass core requires a high-speed water jet to remove it.

From a Computer Aided Engineering result, it has been determined that the center of the top region of the interbore bridge is the hottest region, and covers about 40% of the piston ring travel path. Heat flux starts to reduce dramatically after about 40% of the piston stroke. Therefore, cross-drilled passages are not at the hottest part of the interbore bridge and therefore are not totally effective in providing the cooling where it is required. Furthermore, they require complex and relatively expensive drilling operations.

It is therefore the principal object of the present invention to provide an interbore cooling system for water cooled engines to provide a relatively high level of cooling with a relatively low production costs and time.

SUMMARY OF THE INVENTION

With the above and other objects in mind, the present invention provides a cooling system for cooling an interbore bridge of a cylinder block of a water cooled engine, the interbore bridge having a top surface and a central region of minimum width; the cylinder block having a water jacket; the cooling system including at least one water passage extending from the top of the interbore bridge in, at or adjacent the central region to the water jacket.

Preferably, there are two water passages, one for each side of the central region; and the water jacket includes two flat surface through which each of the water passages pass, the flat surface being substantially normal to the water passages.

More preferably, the water passages are at an included angle to a vertical axis of the central region, the included angle being less than 90°, preferably from 3° to 30°, more preferably from 5° to 25°, or being 5° or 25°.

Advantageously, each water passage is of constant diameter along its length, the constant diameter preferably being in the range of 1 mm to 3 mm, more preferably being 2 mm.

More advantageously, the water passages are not stepped and are formed by a drilling process which does not include a stepped drilling process.

The present invention also relates to a cylinder block, ladder frame, or bedplate including the above cooling system.

In another aspect, the present invention provides a method of forming at least one cooling passage in a cylinder block to cool an interbore bridge, the interbore bridge having a top surface and the cylinder block having a water jacket; the method including the steps of drilling at least one water passage to extend from the top surface in, at or adjacent a central region having minimum width, to the water jacket.

Preferably, there are two water passages, one for each side of the central region, and there are two flat surfaces formed on the water jacket through which each of the water passages pass, the flat surface being normal to the water passages.

Advantageously, the water passages are at an included angle to a vertical axis of the central region, the included angle being less than 90°, preferably 3° to 30°, more preferably 5° to 25°; or it may be 5° or 25°.

Preferably, each water passage is of constant diameter along its length, more preferably in the range of 1 mm to 3 mm; or may be 2 mm.

More preferably, the water passages are not stepped and are drilled without using a stepped drilling process.

DESCRIPTION OF THE DRAWINGS

In order that the invention may be readily understood and put into practical effect, there shall now be described by way of non-limitative example only preferred embodiments of the present invention, the description being with reference to the accompanying illustrative drawings in which.

DESCRIPTION OF PREFERRED EMBODIMENT

Figure 1:
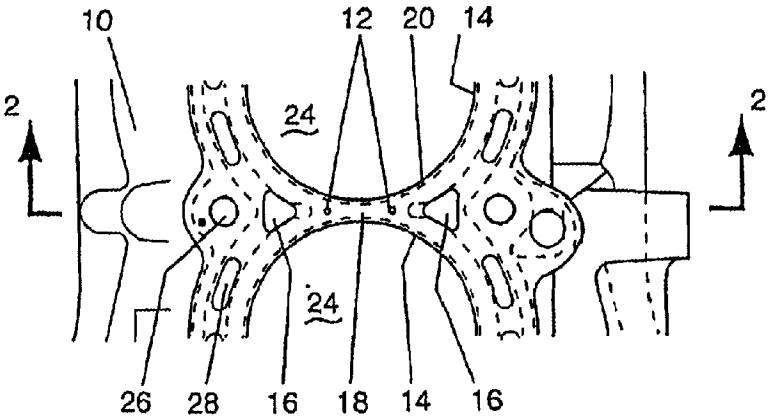
FIG. 1 is a plan view of part of a cylinder block with a first form of the present invention.
Figure 2:
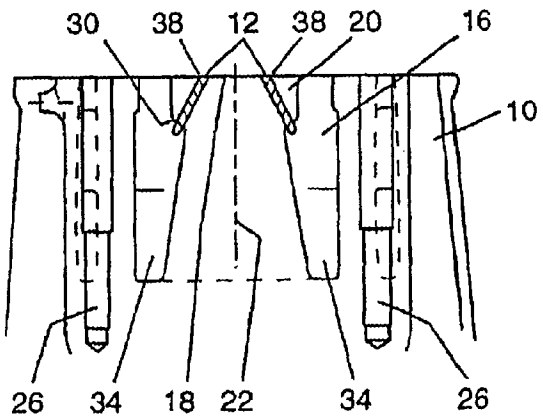
FIG. 2 is a vertical cross-section along the lines and in the direction of arrows 2—2 on FIG. 1.

FIG. 1 and 2 show angled drilled passages 12 in cylinder block 10, the passages 12 not crossing each other. The block 10 has a number of bores 24 each having 2 mm liner 14. After the drilled passages 12 are made, there is still 2.5 mm of metal and 2 mm of liner remaining. Together with a 4 mm minimum gasket width, the gap will provide for adequate sealing. Head bolt holes 26 and water jacket openings 28 are provided, as is normal.

In order to provide at least 4 mm of metal between a water jacket 16 and each liner 14, the closest the water jacket 16 can get to the vertical axis 22 of the centre 18 of the interbore bridge 20 is about 12 mm. As can be seen, the top 38 of the passages is adjacent the centre 18—the region of highest heat concentration. However, they may be at or in the central region 18.

In FIG. 2, the water jacket 16 is extended to provide a surface 30 normal to water passages 12. The surface 30 is relatively flat and is required to ensure the dill bit stays in the original direction, and to reduce the likelihood of damage, and short tool life. The surfaces 30 extend the water jacket 16 towards the vertical axis 22.

Figure 3:
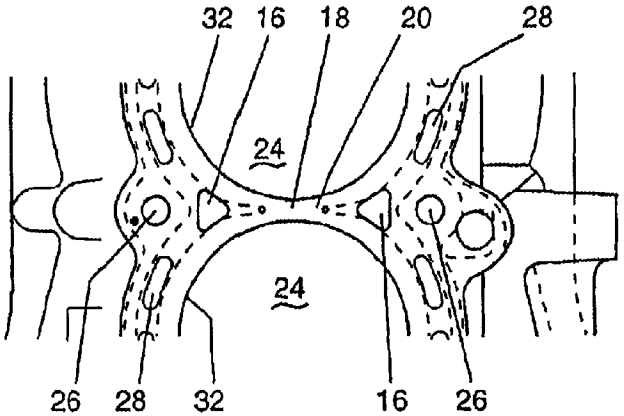
FIG. 3 is a view corresponding to FIG. 1 but of a second form of the present invention.
Figure 4:
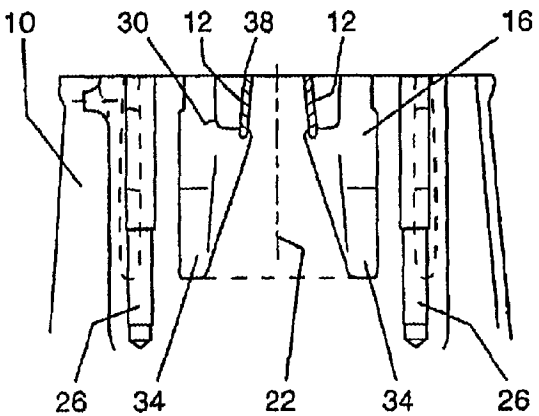
FIG. 4 is a view corresponding to FIG. 2 but of the second form.

It is shown in FIGS. 3 and 4, without the liners 14, the water jacket 16 can be extended further towards the center 18. Assuming a minimum of 4 mm of metal to the cylinder wall surface, the water jacket 16 can be as close as about 11 mm to the vertical axis 22.

The angled drilled passages 12 cool the center of the interbore bridge by bringing the coolant flow as close as possible to the center 18, where the greatest heat concentration is located. In order to bring the coolant as close as possible to the center 18, the smaller the diameter of the passages 12 means the closer they will be to the center 18 of the interbore bridge 20. Taking into account machining feasibility, a drill of 1 to 3 mm, preferably 2 mm, is used. Therefore, the previous long material removal process at the cylinder head can be replaced with two simple drilled passages 12 using a non-stepped drilling process to give passages of relatively constant diameter along their length. These passages 12 will be connected with the two angled passages 34 of the cylinder block 10. In this way, the coolant will pass through the passages 34 in the cylinder block 10 and cylinder head and later be distributed to the cylinder head water jacket. Passages 34 are integrated with the water jacket core. In this way the passages 34 are created during the casting of the block 10. Therefore, only passages 12 are drilled.

The cylinder block water jacket 16 is modified to provide the flat surface 30 normal to the drilled water passages 12. For this reason, the draft split line starts at a plane close to where the drill is to penetrate. By doing so, the water jacket 16 is brought closer to the center in order to cool the area not covered by the drill depth.

The invention is suitable for cylinder blocks 10 with unlined bores 24 and also cylinder blocks 10 with liners 14. However, the use of angled drilled passages 12 is advantageous for cylinder block 10 with liners 14. This is because the cooling ability is not restricted by the placement of liners 14. Instead, the cooling performance is determined by the minimum gasket width.

On the other hand, the use of liners 14 lowers the heat transfer between the surface 32 of the bore 24, and the water jacket 16 and the passages 12. Therefore, the passages 12 represent a significant improvement in cooling ability giving about 20–30° C. temperature reduction for a cylinder block 10 with liners 14.

In case of the unlined bores 24, the heat transfer is better because aluminum has a higher heat transfer coefficient compared to the cast iron liners 14. The use of parent metal bores 24 represents a 20–30° C. reduction over a cylinder block 10 with liners 14. Therefore, the addition of the passages 12 will further lower the temperature by another 20–30° C.

Compared to other forms of interbore cooling, the passages 12 represent a simple method of manufacturing. By using a non-stepped drilling process for the water passages 12 the drill depth is minimized, and production costs are lowered. The machining time will be relatively short because a five-axis drill can be used to drill the passages 12. This eliminates the need for a special shape to be created during casting, which would require a plane normal to the passages 12 to be present for the drill to penetrate. Furthermore, a single drill bit is used for each passage, not a plurality of drill bits of different sizes as is used with cross-drilled passages. Furthermore, extensive milling is also avoided, also aiding the reduction in production costs.

Whilst there has been described in the foregoing description preferred embodiments of the present invention, it will be understood by those skilled in the technology that many variations on modifications in details of design or construction may be made without departing from the present invention.

What is claimed is:

1. A cooling system for cooling an interbore bridge of a cylinder block of a water cooled engine, the interbore bridge having a top surface and a central region of minimum width, the cylinder block having a water jacket, the cooling system comprising two water passages, one for each side of the central region, extending from the top of the interbore bridge adjacent the central region to the water jacket wherein the water jacket includes two flat surfaces through which each of the water passages pass, the flat surfaces being substantially normal to the water passages.

2. The cooling system of claim 1, wherein the water passages are at an included angle to a vertical axis of the central region, the included angle being less than 90°.

3. The cooling system of claim 2, wherein the included angle is in the range of from 3° to 30°.

4. The cooling system of claim 2, wherein the included angle is in the range of from 5° to 25°.

5. The cooling system of claim 4, wherein the included angle is selected from the list comprising 5° and 25°.

6. The cooling system of claim 1, wherein each water passage is of constant diameter along its length.

7. The cooling system of claim 6, wherein the constant diameter is in the range of 1 mm to 3 mm.

8. The cooling system of claim 7, wherein the constant diameter is 2 mm.

9. The cooling system of claim 1, wherein each water passage is not stepped.

10. The cooling system of claim 1, included in a ladderframe or bedplate.

11. A method of forming at least one cooling passage in a cylinder block to cool an interbore bridge, the interbore bridge having a top surface and the cylinder block having a water jacket, the method including the steps of drilling at least one water passage to extend from the top surface adjacent a central region having minimum width, to the water jacket.

12. The method of claim 11, wherein there are two water passages, one for each side of the central region.

13. The method of claim 12, further including the steps of forming two flat surfaces on the water jacket through which each of the water passages pass, the flat surfaces being normal to the water passages.

14. The method of claim 12, wherein the water passages are at an included angle to a vertical axis of the central region, the included angle being less than 90°.

15. The method of claim 14, wherein the included angle is in the range of from 3° to 30°.

16. The method of claim 14, wherein the included angle is in the range of from 5° to 25°.

17. The method of claim 16, wherein the included angle is selected from the list comprising 5° and 25°.

18. The method of claim 12, wherein each water passage is of constant diameter along its length.

19. The method of claim 18, wherein the constant diameter is in the range of 1 mm to 3 mm.

20. The method of claim 19, wherein the constant diameter is 2 mm.

21. The method of claim 12, wherein each water passage is drilled without using a stepped drilling process.

22. The cooling system formed by the method of claim 1 included in a ladderframe or bedplate.

23. An internal combustion engine comprising:

an interbore bridge having a top surface and a central region;

a water jacket; and a cooling system including at least one water passage extending from the top surface adjacent the central region to the water jacket wherein the water jacket includes a flat surface through which the water passage passes, the flat surface being substantially normal to the water passage.

24. A cooling system for cooling an interbore bridge of a cylinder block of a water cooled engine, the interbore bridge having a top surface and a central region of minimum width, the cylinder block having a water jacket, the cooling system comprising at least one water passage extending from the top of the interbore bridge to the water jacket wherein the water jacket includes a flat surface through which the water passage passes, the flat surface being substantially normal to the water passage.

25. The cooling system of claim 24 wherein each water passage is not stepped.

26. The cooling system of claim 24 including a ladderframe or bedplate.

27. A cooling system for cooling an interbore bridge of a cylinder block of a water cooled engine, the interbore bridge having a top surface and a central region of minimum width, the cylinder block having a water jacket, the cooling system comprising at least one water passage of constant diameter along its length, extending from the top of the interbore bridge to the water jacket, wherein the constant diameter is in the range of 1 mm to 3 mm.

28. The cooling system of claim 27 wherein the constant diameter is 2 mm.

29. A cooling system for cooling an interbore bridge of a cylinder block of a water cooled engine, the interbore bridge having a top surface and a central region of minimum width from a vertical axis, the cylinder block having a water jacket, the cooling system comprising at least one water passage extending from the top of the interbore bridge to the water jacket wherein the water jacket includes a flat surface through which the water passage passes, the flat surface extends inward toward the vertical axis.

30. A cooling system for cooling an interbore bridge of a cylinder block of a water cooled engine, the interbore bridge having a top surface and a central region of minimum width from a vertical axis, the cylinder block having a water jacket, the cooling system comprising a first water passage and a second water passage, both extending from the top of the interbore bridge to the water jacket, wherein the first water passage does not connect with the second water passage.

* * * * *